US010065088B2

(12) United States Patent
Hebreo et al.

(10) Patent No.: US 10,065,088 B2
(45) Date of Patent: Sep. 4, 2018

(54) GOLF CLUB HAVING DOUBLE-WALLED STRIKING FACE

(71) Applicant: Acushnet Company, Fairhaven, MA (US)

(72) Inventors: Jonathan Hebreo, San Diego, CA (US); Michael E. Franz, San Diego, CA (US); Marni Ines, San Marcos, CA (US); Joshua C. Stokes, San Marcos, CA (US); Grant M. Martens, Carlsbad, CA (US); Charles E. Golden, Encinitas, CA (US); Uday V. Deshmukh, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 15/184,688

(22) Filed: Jun. 16, 2016

(65) Prior Publication Data

US 2017/0361177 A1 Dec. 21, 2017

(51) Int. Cl.
*A63B 53/04* (2015.01)
*A63B 53/08* (2015.01)

(52) U.S. Cl.
CPC ..... *A63B 53/047* (2013.01); *A63B 53/0475* (2013.01); *A63B 53/08* (2013.01); *A63B 2053/042* (2013.01); *A63B 2053/0454* (2013.01); *A63B 2053/0495* (2013.01)

(58) Field of Classification Search
CPC ..... A63B 53/047; A63B 2053/0416; A63B 2053/042; A63B 2053/0454; A63B 2053/0425; A63B 2053/0429; A63B 53/0475; A63B 2053/0495; A63B 53/08
USPC ..... 473/324–350, 287–292
See application file for complete search history.

(56) References Cited

U.S. PATENT DOCUMENTS 5,083,778 A * 1/1992 Douglass ..... A63B 53/0487 273/DIG. 10
5,295,689 A * 3/1994 Lundberg ..... A63B 53/04 473/346
5,398,929 A * 3/1995 Kitaichi ..... A63B 53/04 473/329
5,839,975 A * 11/1998 Lundberg ..... A63B 53/04 473/346
5,863,261 A * 1/1999 Eggiman ..... A63B 53/04 473/329
6,074,309 A * 6/2000 Mahaffey ..... A63B 53/04 473/342
6,299,547 B1 * 10/2001 Kosmatka ..... A63B 53/04 473/329
6,964,620 B2 * 11/2005 Gilbert ..... A63B 53/04 473/332

(Continued)

*Primary Examiner* — Sebastiano Passaniti

(57) ABSTRACT

A golf club head having a golf club head body and an inner wall structure. The club head body includes a back portion, a striking face, a sole, and a topline. The inner wall structure is at least partially in contact with a rear surface of the striking face. The inner wall structure also has a fixed end and an unfixed end. The golf club head is also configured such that the portion of the inner wall structure in contact with the rear surface of the striking face may slide against one another. The golf club head may also include a sole channel, and the fixed end of the inner wall structure may be attached to either a front edge or back edge of the sole channel.

20 Claims, 10 Drawing Sheets

(56) References Cited

U.S. PATENT DOCUMENTS

| | | | | |
|---|---|---|---|---|
| 7,056,229 | B2 * | 6/2006 | Chen | A63B 53/0466 473/346 |
| 7,247,104 | B2 * | 7/2007 | Poynor | A63B 53/0466 473/329 |
| 7,281,990 | B2 * | 10/2007 | Hagood | A63B 53/04 473/329 |
| 7,582,024 | B2 * | 9/2009 | Shear | A63B 53/0466 473/329 |
| 7,651,408 | B2 * | 1/2010 | Hagood | A63B 53/047 473/329 |
| 7,662,051 | B2 * | 2/2010 | Chen | A63B 53/047 473/342 |
| 8,016,691 | B2 * | 9/2011 | Stites | A63B 53/04 473/290 |
| 8,475,293 | B2 * | 7/2013 | Morin | A63B 53/047 473/329 |
| 8,801,540 | B2 * | 8/2014 | Hebreo | A63B 53/06 473/329 |
| 8,911,301 | B1 * | 12/2014 | Allen | A63B 53/047 473/329 |
| 9,138,622 | B1 * | 9/2015 | DeMille | A63B 53/0475 |
| 9,457,241 | B2 * | 10/2016 | Hebreo | A63B 53/0466 |
| 9,474,945 | B2 * | 10/2016 | Fossum | A63B 53/04 |
| 2003/0190975 | A1 * | 10/2003 | Fagot | A63B 53/04 473/346 |
| 2004/0266545 | A1 * | 12/2004 | Gilbert | A63B 53/04 473/291 |
| 2010/0273565 | A1 * | 10/2010 | Stites | A63B 53/04 473/282 |

* cited by examiner

GOLF CLUB HAVING DOUBLE-WALLED STRIKING FACE

BACKGROUND

It is a goal for golfers to reduce the total number of swings needed to complete a round of golf, thus reducing their total score. To achieve that goal, golfers may often desire to hit a golf ball a long distance. The distance the golf ball travels depends on both the skill of the golfer and the equipment used by the golfer. With respect to the golf club, the construction of a striking face, along with other elements of the club, has an effect on the outgoing speed of a ball when struck by the club. For example, as the striking face contacts the golf ball, the striking face may provide a spring-like effect, adding to the speed of the golf ball as it leaves the club face.

SUMMARY

In one aspect, the technology relates to a golf club head having a club head body and an inner wall structure. The golf club head body includes a back portion, a striking face, a sole, and a topline. The inner wall structure is at least partially in contact with a rear surface of the striking face, and has a first end fixed to the club head body and a second unfixed end. A portion of the inner wall structure is configured to slide against the rear surface of the striking face. In an embodiment, the first end of the inner wall structure is fixed to the sole. In another embodiment, the first end of the inner wall structure is fixed to the back portion. In yet another embodiment, the golf club head also includes a recess in an internal portion of the topline, the recess configured to receive the second end of the inner wall structure. In still yet another embodiment, the club head body defines a sole channel having a front edge and a back edge.

In another embodiment, the first end of the inner wall structure is fixed to one of the back edge of the sole channel and the front edge of the sole channel. In yet another embodiment, at least a portion of the inner wall structure is coated with a polymer. In still yet another embodiment, a portion of the inner wall structure in contact with the rear surface of the striking face has a thickness approximately double a thickness of the striking face.

In another embodiment, the inner wall structure is made from a first material and the striking face is made from a second material, the first material having a higher elastic modulus than the second material. In yet another embodiment, the striking face is secured to the topline and not secured to the sole.

In another aspect, the technology relates to a golf club including a topline; a striking face attached to the topline; a back portion attached to the topline; a sole attached to one of the striking face and the back portion; and an inner wall structure at least partially in contact with a rear surface of the striking face, the inner wall structure configured to slide against the rear surface of the striking face, wherein the sole defines a sole channel defined by a front edge and a back edge, the sole channel separating a portion of the sole from one of the striking face and the back portion. In an embodiment, the inner wall structure is attached to the back edge of the sole channel. In another embodiment, the topline defines an inner recess configured to receive a portion of the inner wall structure. In yet another embodiment, the striking face has a first portion in contact with the inner wall structure and a second portion not in contact with the inner wall structure, the second portion having a thickness greater than a thickness of the first portion. In still yet another embodiment, a portion of the inner wall structure in contact with the rear surface of the striking face has a thickness approximately double a thickness of the striking face.

In another embodiment, the inner wall structure is made from a first material and the striking face is made from a second material, the first material having a higher elastic modulus than the second material; and the inner wall structure has a thickness approximately equal to the thickness of the striking face. In yet another embodiment, the striking face is not secured to the sole portion.

In yet another aspect, the technology relates to a golf club head including: a striking face having a top edge attached to a topline and a bottom edge proximate the bottom of the face; a back portion attached to the topline; a sole portion attached to the back portion, the sole portion including a sole channel; and an inner wall structure. The inner wall structure has a fixed end attached to the sole portion; an unfixed end disposed in a recess defined by an inner surface of the topline; a contact portion in contact with a rear surface of the striking face; and a support portion attached to the fixed end and not in contact with the rear surface of the striking face. In an embodiment, the contact portion of the inner wall structure has a thickness at least double a thickness of the striking face. In another embodiment, the support portion of the inner wall structure has one of an s-shape, a c-shape, and v-shape.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head, such as an iron, fairway metal, driver, or other golf club head, that includes a double-walled striking face, e.g., a golf club head having an inner wall structure in contact with an outer striking face. In examples, such club heads may include a sole channel. One end of the inner wall structure is fixed to the golf club head, while another end of the inner wall structure is unfixed, allowing the inner wall structure to slide against a rear surface of the striking face. Such an inner wall structure contributes to a spring effect of the striking face, thus improving ball speed and launch characteristics from strikes near the center and top of the striking face. The golf club head may also include a sole channel that creates improved ball speed and launch characteristics for strikes near the center and bottom of the striking face. Accordingly, the use of the double-walled striking face and the sole channel in tandem provide improved launch characteristics, such as launch angles, spin characteristics, and ball speed, across the entire striking face, from the topline to the sole. Thus, both shots from the turf and off a tee produce improved launch characteristics.

Figure 1B:
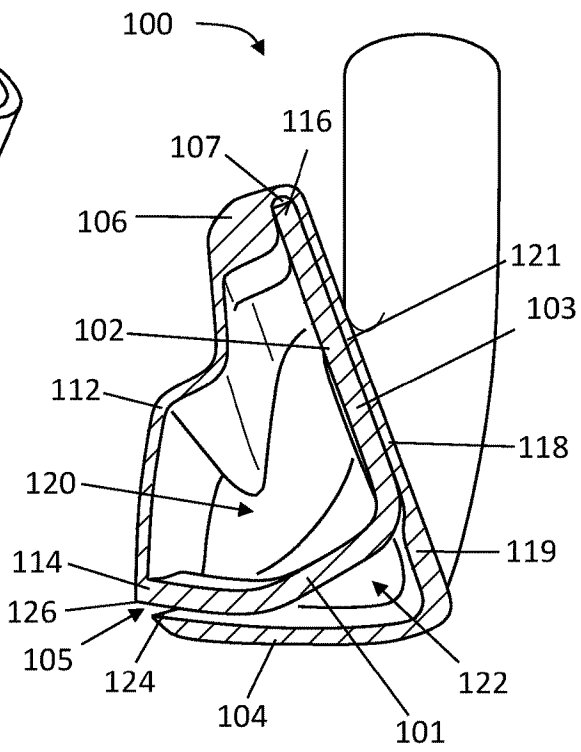
FIG. 1B depicts a section view of an example of a golf club head having a double-walled striking face and a sole channel.
Figure 1A:
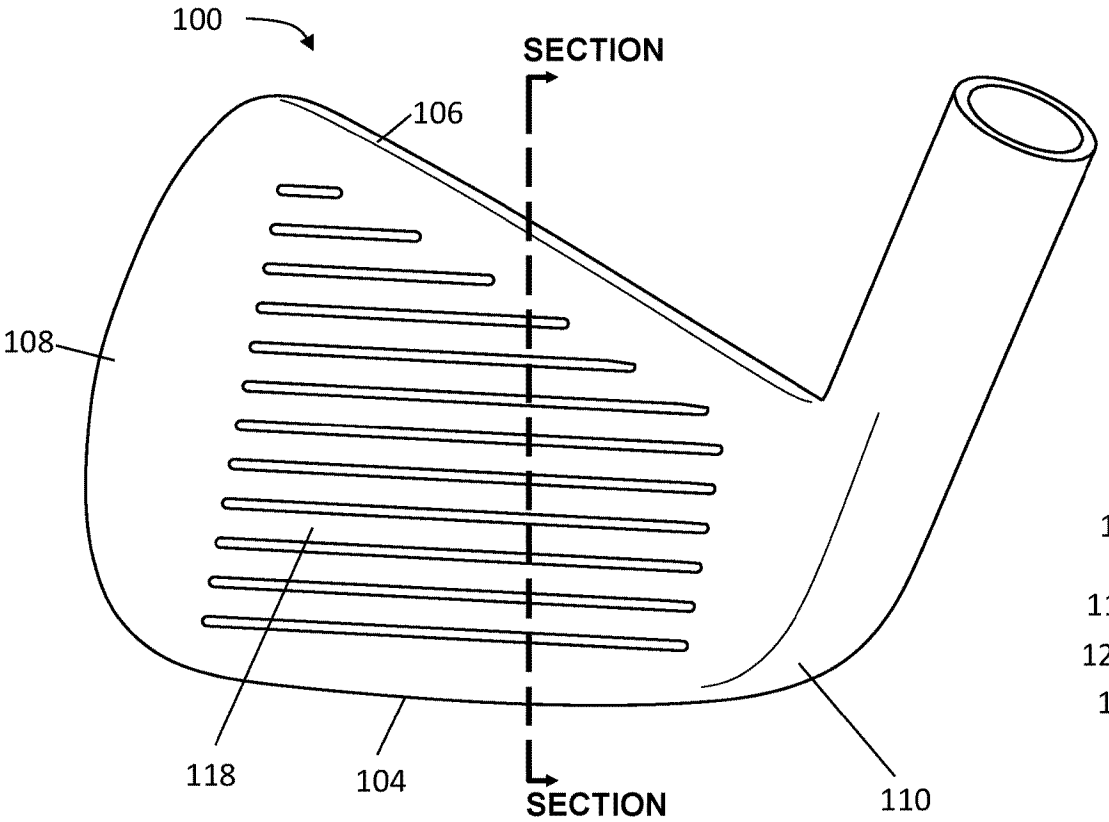
FIG. 1A depicts a perspective view of a golf club.

FIG. 1A depicts a perspective view of a golf club head 100 having an inner wall structure 102 and a sole channel 105, and FIG. 1B depicts a section view of the golf club head 100. FIGS. 1A-1B are described concurrently. The golf club head 100 includes striking face 118 attached to a sole portion 104, a toe portion 108, a topline 106, and a heel portion 110. The topline 106 is also attached to a back portion 112. The inner wall structure 102 extends from the back portion 112 towards the striking face 118, and a first cavity 120 is partially defined (in section) by the back portion 112, the topline 106, and the inner wall structure 102. The inner wall structure 102 includes a fixed end 114, attached to the back portion 112, and an unfixed end 116. The fixed end 114 may be attached to the back portion 112 via welding, brazing, or fastening, such as with screws or rivets, along with any other suitable attachment methods. The unfixed end 116 is received by a recess 107 in an internal portion of the topline 106. The recess 107 is shaped or configured so as to receive, but not fix or secure, the unfixed end 116 of the inner wall structure 102, such that the unfixed end 116 may move freely therefrom. The inner wall structure 102 also includes a support portion 101 and a contact portion 103. The support portion 101 supports the contact portion 103, which is in contact with a rear surface of the striking face 118. In the example depicted, the support portion 101 generally has an angled v-shape from the back portion 112 to the striking face 118, and a component of the support portion 101 extends substantially orthogonal to the striking face 118. The contact portion 103 runs substantially parallel to the striking face 118. Lubrication may be disposed between the contact portion 103 and the striking face 118 so as to reduce the friction between those elements. This allows for easier sliding of the surfaces against one another. Further, in some examples, additional machining or processing is performed on these contacting elements to create extra-smooth surfaces to further reduce friction therebetween. The contact portion 103 may also be coated with a polymer, such as a TEFLON-brand coating available from E. I. duPont de Nemours and Company of Wilmington, Del., or other similar materials for management of vibrations, friction, and alteration of sound properties emitted upon striking a golf ball.

The striking face 118 may also have multiple thicknesses, including a thick portion 119 and a thin portion 121. The thick portion 119 has a thickness greater than a thickness of the thin portion 121. Because the inner wall structure 102 provides additional support to the thin portion 121, the thin portion 121 may be thinner than it would otherwise be in the absence of the inner wall structure 102. In an example, the thick portion 119 has a thickness that is approximately double the thickness of the thin portion 121. In one example, the thin portion 121 may have a thickness of approximately 0.9 mm and the thick portion 119 may have a thickness of approximately 1.4 mm.

The thickness of the contact portion 103 and the thin portion 121 of the striking face 118 may also differ. For example, the contact portion 103 may have a thickness that is approximately double the thickness of the thin portion 121 of the striking face 118. In some examples, the ratio of the thickness of the contact portion 103 to the thickness of the thin portion 121 of the striking face 118 may be approximately 1.5:1, 2.5:1, or 3:1. In other examples, the thickness of the contact portion 103 may be approximately the same as that of the thick portion 119 of the striking face 118.

The types of materials used to create the inner wall structure 102 and the striking face 118 may also differ. As an example, the inner wall structure 102 may be made of a low-density material with a high strength, while the striking face 118 may be made of a material with a relatively higher density and a relatively lower strength. As another example, the striking face 118 may be made from a material having a low elastic modulus while the inner wall structure 102 may be made form a material having a relatively higher elastic modulus. For instance, the striking face 118 may be made from a steel material and the inner wall structure 102 may be made from a titanium material. In another instance, the inner wall structure 102 may be made from a high-strength steel, such as maraging C350 steel, and the striking face 118 may be made from a lower strength steel, such as maraging C300 steel. In the above examples using different types of materials, the thickness of the contact portion 103 may be approximately the same as the thickness of the thin portion 121 of the striking face 118. Such materials may also be coated with a polymer for damping vibration and managing friction between surfaces. For instance, the contact portion 103 could be coated with a low-friction polymer.

The golf club head 100 may also include a sole channel 105. The sole channel 105 includes a front edge 124 and a back edge 126. The sole channel 105 may extend from near the heel portion 110 to the toe portion 108 and may be substantially the same width as the striking face 118. In the example depicted, the sole channel 105 separates the back portion 112 from the sole portion 104. The fixed end 114 of the inner wall structure 102 is attached to the back portion 112 at the back edge 126. The sole channel 105 defines a through-hole into a second cavity 122 that is partially defined (in section) by the thick portion 119, the sole portion 104, and the inner wall structure 102. In some examples, the sole channel 105 is filled with or spanned by a polymer or other elastic material to prevent debris from entering the second cavity 122. The incorporation of the sole channel 105 allows for further deflection of lower portions of the striking face 118, thus providing additional ball speed from golf ball strikes occurring in lower regions of the striking face 118.

Figure 1D:
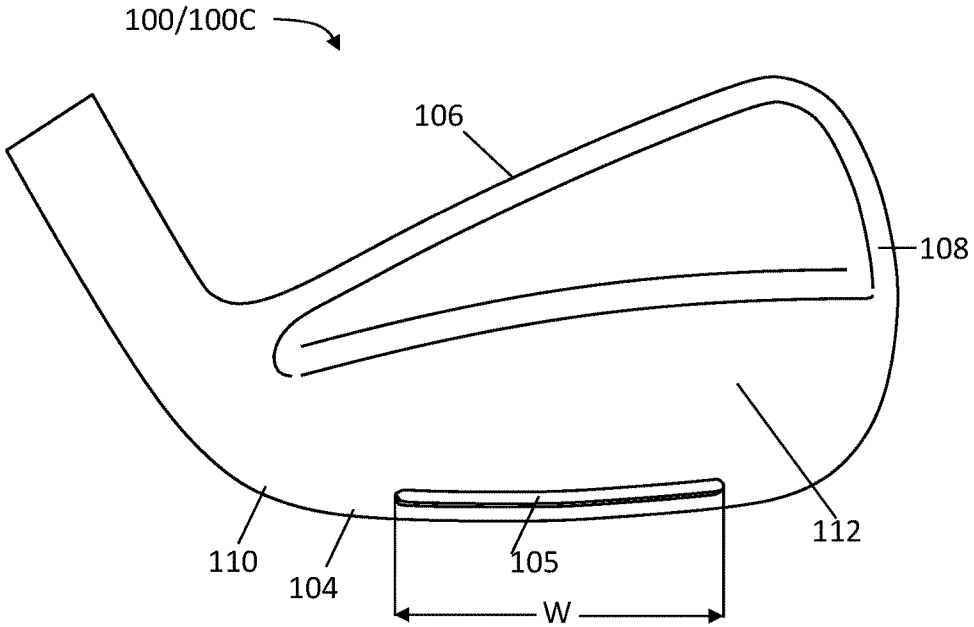
FIG. 1D depicts a back view of the golf club head depicted in FIGS. 1A-1C.
Figure 1C:
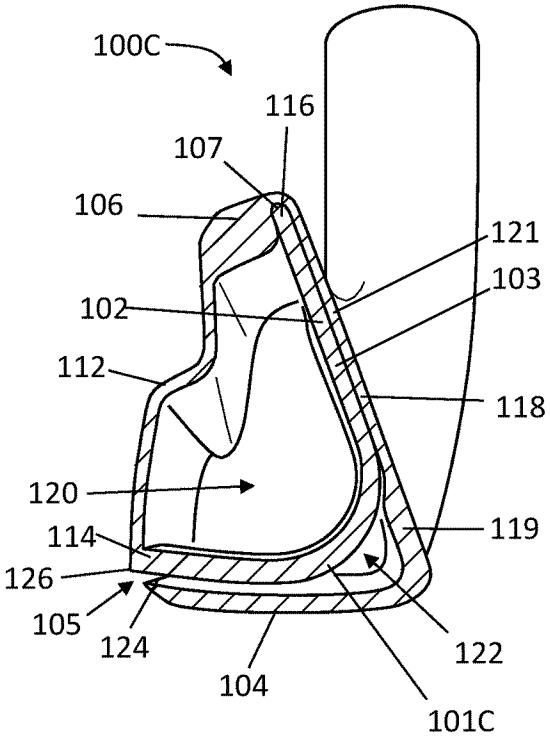
FIG. 1C depicts a section view of another example of a golf club head having a double-walled striking face and a sole channel.

FIG. 1C depicts a section view of another example of a golf club head 100C having an inner wall structure 102 and a sole channel 105. The golf club head 100C is substantially the same as the golf club head 100 depicted in FIG. 1B and, as such, not all element thereof are described further. In golf club head 100C, however, the support portion 101C has a curved C-shape. The curved C-shape of support portion 101C allows for more deflection of the striking face 118 and the contact portion 103 because the component of the curved C-shape that is orthogonal to the striking face 118 is reduced in size.

FIG. 1D depicts a back view of the golf club heads 100, 100C depicted in FIGS. 1A-1C. The sole channel 105 runs across a bottom side of the back portion 112 in a direction substantially parallel to the striking face 118. In the example depicted, the sole channel 105 separates a portion of the sole portion 104 from the back portion 112. In some embodiments, the sole channel 105 may have a width W that is approximately the same as the width of the striking face 118 and/or the width of the inner wall structure 102. In other examples, the width W of the sole channel 105 is approximately the same as the diameter of a golf ball (i.e., about 1.6-1.7 inches) or greater. As discussed above, the sole channel 105 may also be filled with or spanned by an elastic material.

Figure 2A:
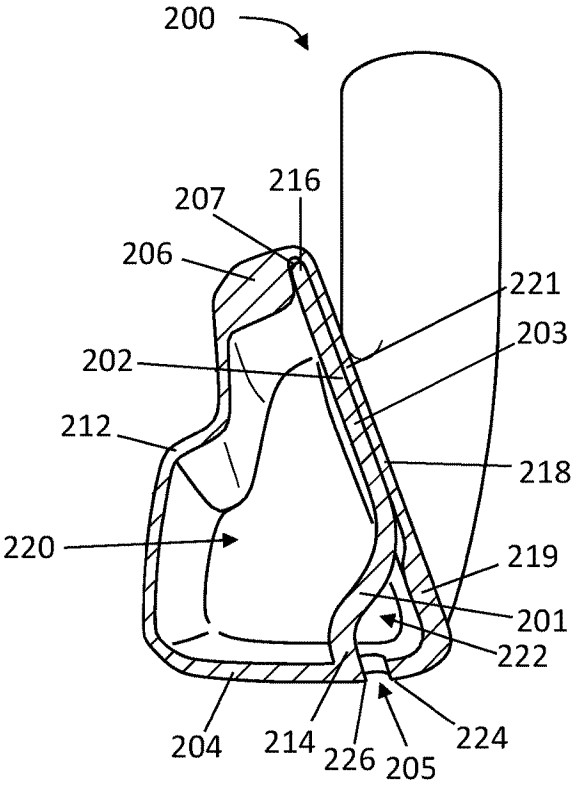
FIG. 2A depicts a section view of another example of a golf club head having a double-walled striking face and a sole channel.
Figure 2B:
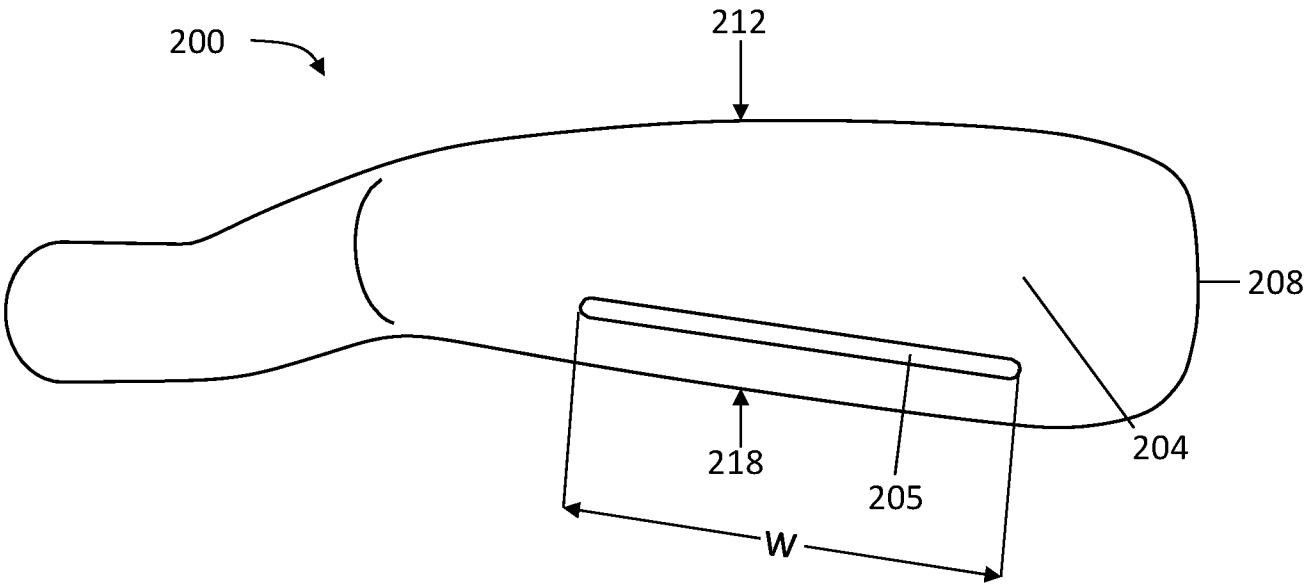
FIG. 2B depicts a bottom view of the golf club head of FIG. 2A.

FIGS. 2A-2B depict a section view and a bottom view, respectively, of another golf club head 200 and are described concurrently. The golf club head 200 is similar to the golf club heads 100, 100C depicted in FIGS. 1A-1C and described above. As such, elements common to both configurations are numbered similarly, but are not necessarily described further. An inner wall structure 202 includes a support portion 201, a contact portion 203, a fixed end 214, and an unfixed end 216. The support portion 201 has a curved S-shape and the contact portion 203 is substantially parallel to the striking face 218. The striking face 218 may also include a thick portion 219 and a thin portion 221. Two cavities are also formed: a first cavity 220 and a second cavity 222.

The sole channel 205 is located proximate to the striking face 218. By moving the sole channel 205 closer to the striking face 218, the deflection of the thick portion 219 of the striking face 218 is increased when striking a golf ball. The back edge 226 of the sole channel 205 is formed by a rear segment of the sole portion 204 and the front edge 224 of the sole channel 205 is formed by a front segment of the sole portion 204. Because less of the sole portion 204 is directly attached to the striking face 218, there is less resistance to deflection of the thick portion 219. Accordingly, the increased deflection may provide for increased ball speeds resulting from ball strikes occurring near the thick portion 219 of the striking face 218. The sole channel 205 may also run substantially parallel to the striking face 218, as shown in FIG. 2B. The sole channel 205 may also be filled with or spanned by an elastic material.

Figure 3:
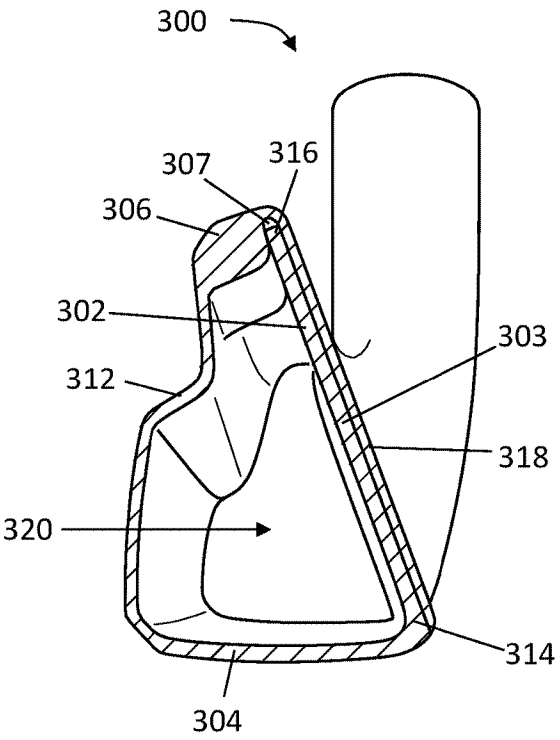
FIG. 3 depicts a section view of another example of a golf club head having a double-walled striking face.

FIG. 3 depicts another example of a golf club head 300. The golf club head 300 is similar to golf club heads described above, and as such, elements common to those configurations and the golf club head 300 are numbered similarly, but are not necessarily described further. The golf club head 300 includes a striking face 318 that is attached to the topline 306, the toe portion 308 and the heel portion 310, but is at least partially not attached to the sole portion 304. Accordingly, the striking face 318 is effectively hinged at the topline 306 allowing for movement of the striking face 318. In other embodiments, the striking face 318 may also not be directly attached to the toe portion 308 or the heel portion 310.

The inner wall structure 302 includes a fixed end 314 and an unfixed end 316. The fixed end 314 is attached to a front edge of the sole portion 304 directly behind the striking face 318. The inner wall structure 302 may not include a support portion, as the entire inner wall structure 302 is in contact with the rear surface of the striking face 318. In some examples, however, the inner wall structure 302 may include a small support portion to allow for attachment to the sole portion 304 via welding or other fastening measures. Unlike the embodiments depicted above, only a single cavity 320 is present.

The inner wall structure 302 and the striking face 318 are fixed, or effectively hinged, at opposite portions of the golf club head 300. More specifically, in the example depicted, the inner wall structure 302 has a fixed end 314 at the sole portion 304 and an unfixed end 316 near the topline 306, and the striking face 318 has a fixed end at the topline 306 and an unfixed end near the sole portion 304. Such a configuration allows the inner wall structure 302 to slide against the rear surface of the striking face 318 and also to deflect separately from the striking face 318. For example, upon a strike of a golf ball, the striking face 318 moves in an upward direction while the inner wall structure 302 moves downward.

In other examples, the fixed and unfixed ends of the inner wall structure 302 and the striking face 318 may be inverted from the example depicted in FIG. 3. That is, the inner wall structure 302 may have a fixed end at the topline 306 and an unfixed end near the sole portion 304, and the striking face 318 may have a fixed end at the sole portion 304 and an unfixed end near the topline 306. In yet other examples, the inner wall structure 302 may have a fixed end at the toe portion 308 and an unfixed end near the heel portion 310, and the striking face 318 may have a fixed end at the heel portion 310 and an unfixed end near the toe portion 308, or vice versa.

Further, because substantially the entire rear surface of the striking face 318 is in contact with the inner wall structure 302, the thickness of the striking face 318 may be uniform. The thickness of the striking face 318 may also be less than the thickness of the inner wall structure 302, and the striking face 318 and the interior wall structure 302 may also be made of different materials.

Figure 4A:
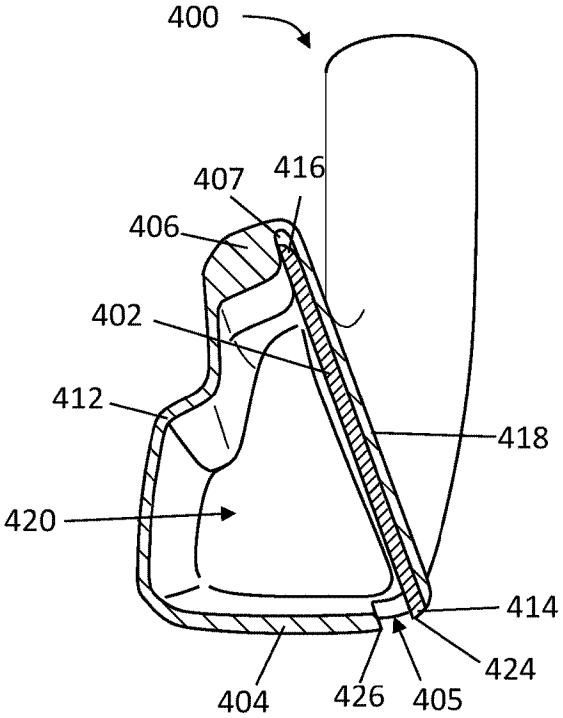
FIG. 4A depicts a section view of another example of a golf club head having a double-walled striking face and a sole channel.
Figure 4B:
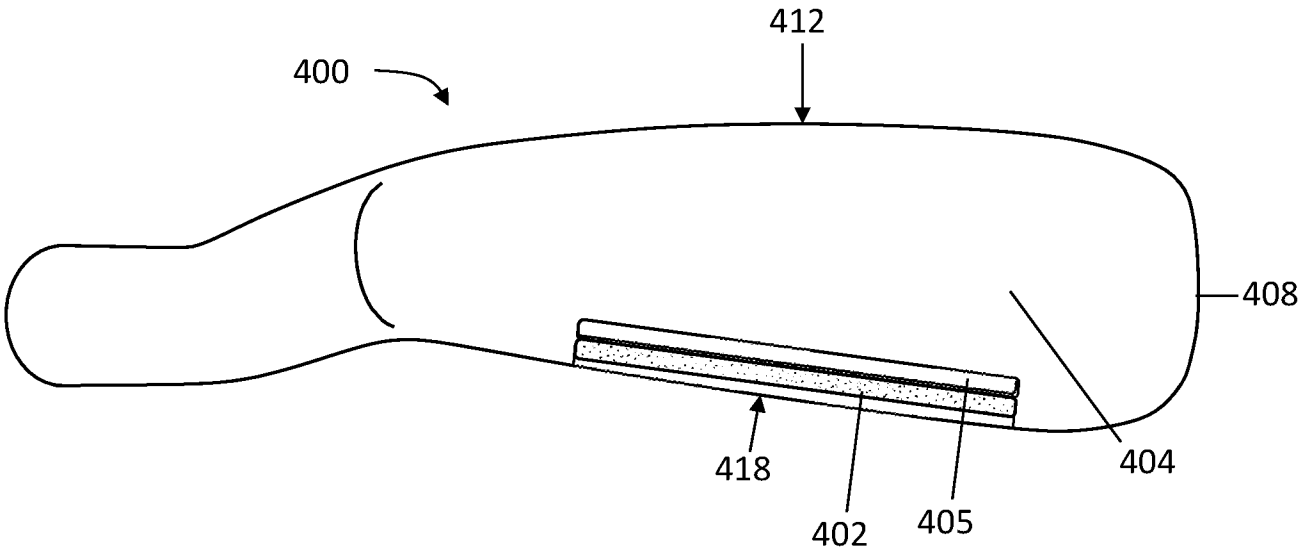
FIG. 4B depicts a bottom view of the golf club head of FIG. 4A.

FIGS. 4A-4B depict a section view and a bottom view, respectively, of another golf club head 400 and are described concurrently. The golf club head 400 is similar to the golf club heads described above. As such, elements common to the configuration of the golf club head 400 and the golf club heads described above are numbered similarly, but are not necessarily described further. The inner wall structure 402 of the golf club head 400 includes a fixed end 414 and an unfixed end 416. The fixed end 414 may be attached to the sole portion 404, toe portion 408, and/or the heel portion 410, and the unfixed end 416 is received in a recess 407 in the interior portion of the topline 406. In some embodiments, the inner wall structure 402 may be wider than the sole channel 405, and the fixed end 414 of the inner wall structure 402 may be attached to segments of the sole portion 404 that extend outside the sole channel 405 towards the toe portion 408 and the heel portion 410. The striking face 418 has a fixed end at the topline 406 and an unfixed end near the sole portion 404. Accordingly, the inner wall structure 402 may slide against the rear surface of the striking face 418. In some examples, the striking face 418 may also be attached to the toe portion 408 and/or the heel portion 410.

The sole channel 405 is located near the front of the golf club head 400 and separates the inner wall structure 402 and the striking face 418 from the remainder of the sole portion 404. For instance, the front edge 424 of the sole channel 405 is defined by the fixed end 414 of the inner wall structure 402, and the back edge 426 is defined the sole portion 404. By locating the sole channel 405 further towards the front of the golf club head 400, the bottom portion of the striking face 418 is able to more easily deflect, further adding to the ball speed resulting from a strike on the lower portion of the striking face 418. The sole channel 405 may also be filled with or spanned by an elastic material. In some embodiments, a flexible coating may also coat the bottom of the golf club head 400 to cover the edges of the striking face 418 and any external edges of the inner wall structure 402, e.g., so as to prevent wear.

Figure 5A:
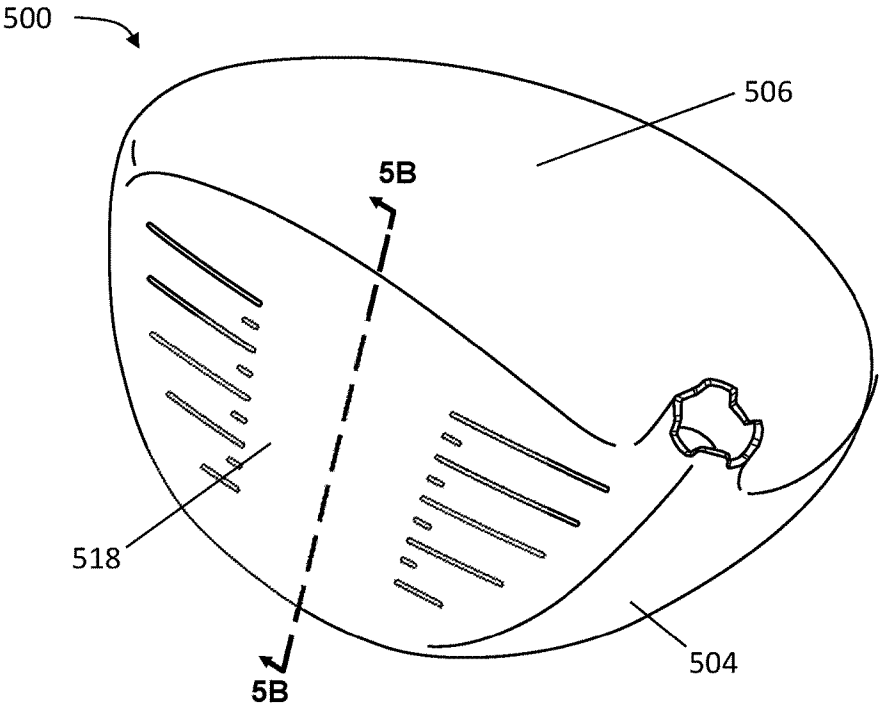
FIG. 5A depicts a perspective view of a golf club head of a driver having a double-walled striking face and a sole channel.
Figure 5B:
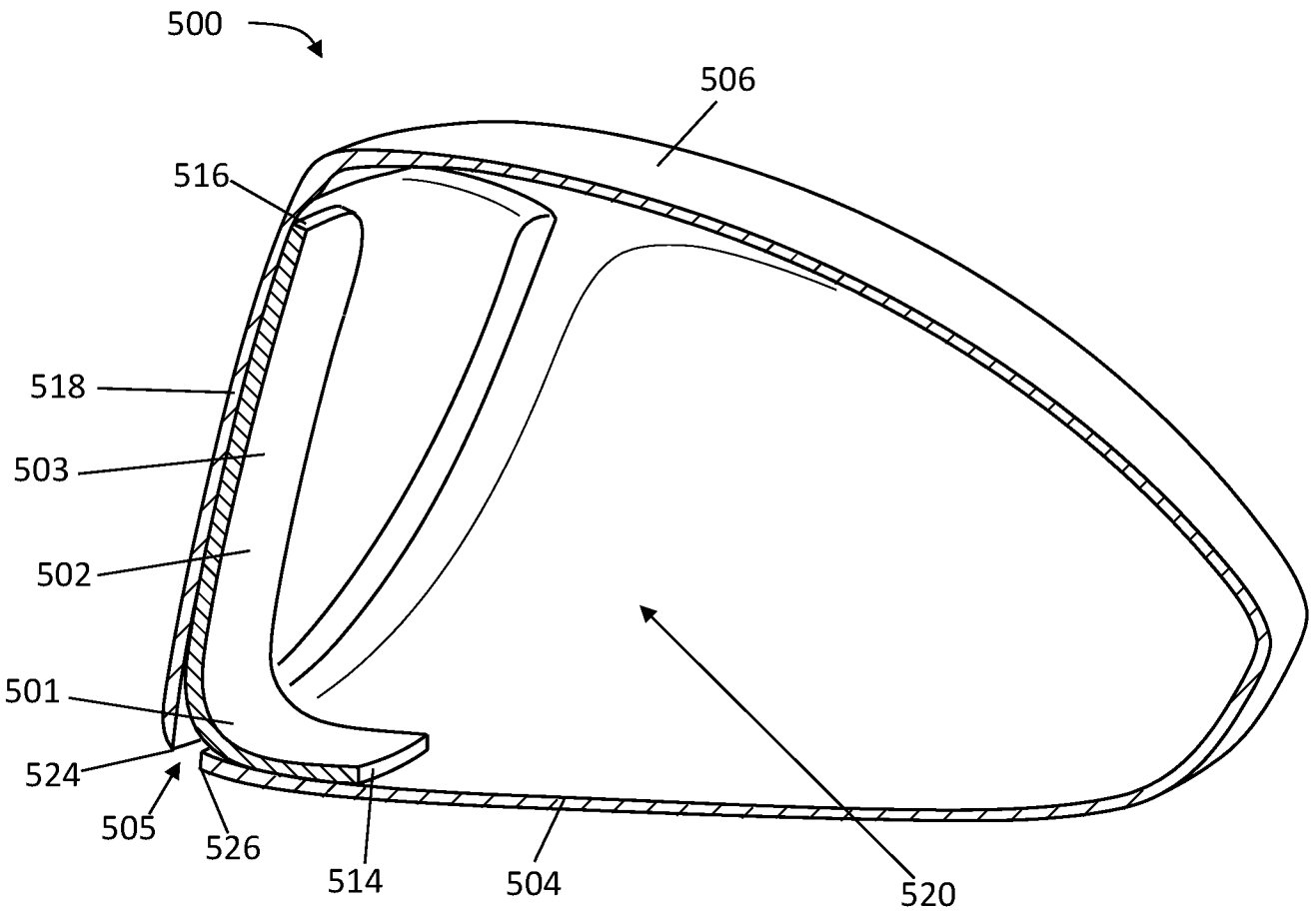
FIG. 5B depicts a section view of the golf club head of FIG. 5A.
Figure 5C:
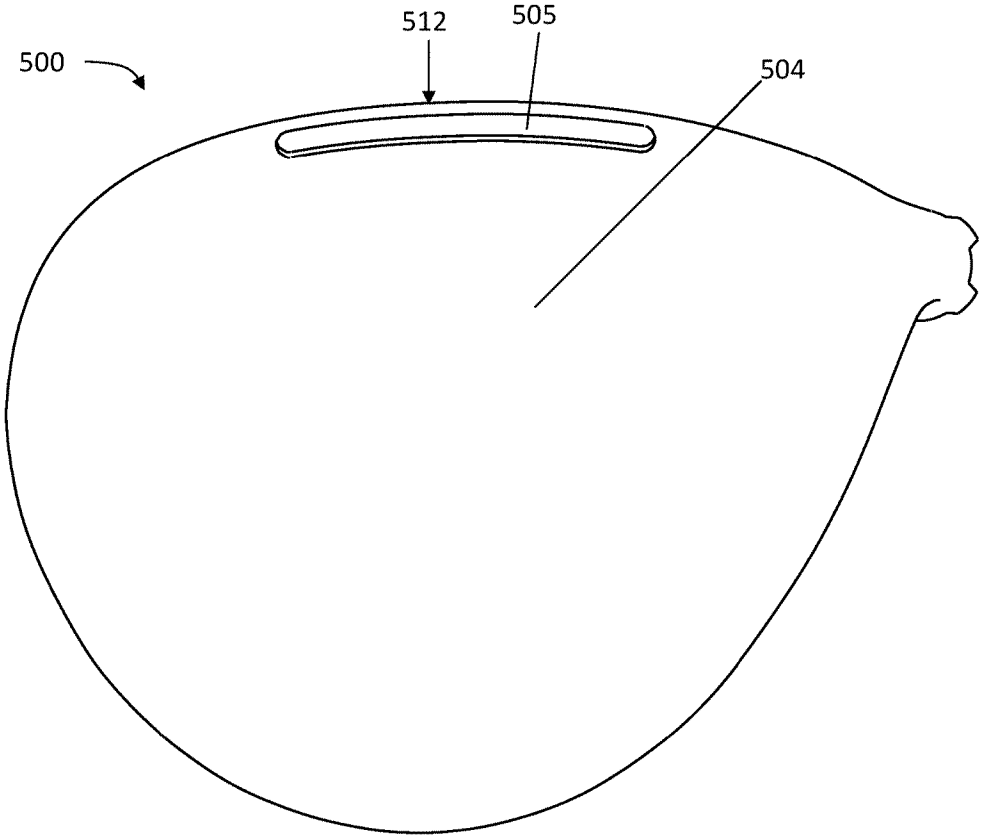
FIG. 5C depicts a bottom view of the golf club head of FIGS. 5A-5B.

FIG. 5A depicts a perspective view of a golf club head 500 of a driver having an inner wall structure 502 and a sole channel 505. FIG. 5B depicts a section view of the golf club head 500, and FIG. 5C depicts a bottom view of the golf club head 500. FIGS. 5A-5C are described concurrently. The golf club head 500 includes a crown 506 and a sole portion 504 attached thereto. The golf club head 500 also includes a striking face 518 attached to the crown 506 and a segment of the sole portion 504. The inner wall structure 502 includes a fixed end 514 attached to the sole portion 504 near the back edge 526 of the sole channel 505. An unfixed end 516 is not fixed to the striking face 518 or the crown 506. In some embodiments, the crown 506 may include a recess (not shown) for receiving the unfixed end 516 of the inner wall structure 502 as with the configurations described above. The inner wall structure 502 also includes a support portion 501 and a contact portion 503. The support portion 501 may be a curved c-shape, a curved s-shape, or some other shape. The contact portion 503 may contact the majority of the rear surface of the striking face 518. In some examples, substantially the entire rear surface of the striking face 518 is backed by the inner wall structure 502. In some embodiments, the striking face 518 and the inner wall structure may be constructed of the same or similar materials as discussed above. Further, the contact portion 103 may be coated with a polymer for managing vibration, sounds properties, and to reduce friction. The golf club head 500 also includes a cavity 520 partially defined (in section) by the sole portion 504, the crown 506, and the inner wall structure 502.

The sole channel 505 is incorporated into the sole portion 504. In the example depicted, the front edge 524 of the sole channel 505 is defined by a bottom edge of the striking face 518, and the back edge 526 of the sole channel 505 is defined by the sole portion 504. Accordingly, the sole channel 505 separates a portion of the striking face 518 from the sole portion 504. The sole channel 505 may have a width substantially the size of a golf ball diameter or larger. In some examples, the sole channel 505 may have a width more than double the size of a golf ball diameter. Many of the benefits and features from the sole channels and inner wall structures discussed above are also applicable to the golf club head 500. Further, while sole channel 505 and the inner wall structure 502 are shown in the golf club head 500 of a driver, such structures may be incorporated into other metal woods, such as fairway metal woods and hybrid clubs.

Although specific embodiments and aspects were described herein and specific examples were provided, the scope of the technology is not limited to those specific embodiments and examples. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

The invention claimed is:

1. A golf club head comprising:
a club head body comprising a back portion, a striking face, a sole, and a topline; and
an inner wall structure at least partially in contact with a rear surface of the striking face, the inner wall structure having a first end fixed to the back portion and a second unfixed end,
wherein a channel is defined between the back portion and the sole;
a first cavity defined at least in part by the inner wall structure, the topline, and the back portion, and
a second cavity defined at least in part by the inner wall structure, the sole, and the striking face, wherein the first cavity is separated from the second cavity by the inner wall structure and the channel defines a through-hole into the second cavity.

2. The golf club head of claim 1, wherein the first end of the inner wall structure is fixed to the back portion at a point closest to the sole.

3. The golf club head of claim 1, further comprising a recess in an internal portion of the topline, wherein the second end of the inner wall structure is disposed in the recess.

4. The golf club head of claim 1, wherein the channel has a front edge on the sole and a back edge on the back portion.

5. The golf club head of claim 4, wherein the first end of the inner wall structure is fixed to the back edge of the channel.

6. The golf club head of claim 1, wherein at least a portion of the inner wall structure is coated with a polymer.

7. The golf club head of claim 1, wherein a portion of the inner wall structure in contact with the rear surface of the striking face has a thickness approximately double a thickness of the striking face.

8. The golf club head of claim 1, wherein the inner wall structure is made from a first material and the striking face is made from a second material, the first material having a higher elastic modulus than the second material.

9. The golf club head of claim 1, wherein the striking face is secured to the topline.

10. A golf club head comprising:
a topline;
a striking face attached to the topline;
a back portion attached to the topline;
a sole attached to the back portion;
an inner wall structure at least partially in contact with a rear surface of the striking face, the inner wall structure configured to slide against the rear surface of the striking face, wherein the sole, the inner wall structure, and the rear surface of the striking face define a sole channel, the sole channel separating a portion of the sole from the striking face;
a first cavity defined at least in part by the inner wall structure, the topline, and the back portion, and
striking face, wherein the first cavity is separated from the second cavity by the inner wall structure and the sole channel defines a through-hole into the second cavity.

11. The golf club head of claim 10, wherein the inner wall structure is attached to a back edge of the sole channel.

12. The golf club head of claim 10, wherein the topline defines an inner recess configured to receive a portion of the inner wall structure.

13. The golf club head of claim 10, wherein the striking face has a first portion in contact with the inner wall structure and a second portion not in contact with the inner wall structure, the second portion having a thickness greater than a thickness of the first portion.

14. The golf club head of claim 10, wherein a portion of the inner wall structure in contact with the rear surface of the striking face has a thickness approximately double a thickness of the striking face.

15. The golf club head of claim 10, wherein:

the inner wall structure is made from a first material and the striking face is made from a second material, the first material having a higher elastic modulus than the second material; and the inner wall structure has a thickness approximately equal to the thickness of the striking face.

16. The golf club head of claim 11, wherein the striking face is not secured to the sole portion.

17. A golf club head comprising:

a striking face having a top edge attached to a topline and a bottom edge proximate the bottom of the face;

a back portion attached to the topline;

a sole portion attached to the back portion, the sole portion including a sole channel; and an inner wall structure, the inner wall structure having:

a fixed end attached to the sole portion;

an unfixed end disposed in a recess defined by an inner surface of the topline;

a contact portion attached to the unfixed end and in contact with a rear surface of the striking face; and a support portion attached to the fixed end and not in contact with the rear surface of the striking face.

18. The golf club head of claim 17, wherein the contact portion of the inner wall structure has a thickness at least double a thickness of the striking face.

19. The golf club head of claim 17, wherein the support portion of the inner wall structure has one of an s-shape, a c-shape, and v-shape.

20. The golf club head of claim 17, wherein:

the inner wall structure is made from a first material and the striking face is made from a second material, the first material having a higher elastic modulus than the second material; and the inner wall structure has a thickness approximately equal to the thickness of the striking face.

* * * * *